US008068775B2

(12) United States Patent
Inaba et al.

(10) Patent No.: US 8,068,775 B2
(45) Date of Patent: Nov. 29, 2011

(54) IMAGE FORMING APPARATUS WITH TRANSFER MEMBER FOR TRANSFERRING TONER ON IMAGE BEARING MEMBER

(75) Inventors: Yuichiro Inaba, Chigasaki (JP); Masaru Shimura, Numazu (JP); Kenji Kanari, Numazu (JP); Kazuhiro Doda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 12/059,262

(22) Filed: Mar. 31, 2008

(65) Prior Publication Data

US 2008/0253813 A1 Oct. 16, 2008

(30) Foreign Application Priority Data

Apr. 10, 2007 (JP) ..... 2007-102519

(51) Int. Cl.
*G03G 15/20* (2006.01)
*G03G 15/16* (2006.01)

(52) U.S. Cl. ..... 399/310; 399/318

(58) Field of Classification Search ..... 399/310, 399/318, 121, 297, 303
See application file for complete search history.

(56) References Cited

U.S. PATENT DOCUMENTS

| | | | | |
|---|---|---|---|---|
| 4,260,236 | A * | 4/1981 | Tsuda et al. | 399/18 |
| 4,682,880 | A | 7/1987 | Fujii et al. | |
| 5,517,290 | A * | 5/1996 | Marumoto et al. | 399/313 |
| 5,576,820 | A * | 11/1996 | Hagihara et al. | 399/121 |
| 5,697,030 | A | 12/1997 | Hayashi et al. | |
| 5,915,145 | A | 6/1999 | Shimura et al. | |
| 5,918,096 | A | 6/1999 | Sano et al. | |
| 6,266,495 | B1 | 7/2001 | Yuminamochi et al. | |
| 6,711,367 | B2 | 3/2004 | Saito et al. | |
| 6,963,716 | B2 | 11/2005 | Kobayashi et al. | |
| 2004/0005168 | A1 * | 1/2004 | Baek | 399/116 |
| 2004/0109709 | A1 * | 6/2004 | Ishibashi et al. | 399/303 |

FOREIGN PATENT DOCUMENTS

| | | | |
|---|---|---|---|
| JP | 8-339131 | A | 12/1996 |
| JP | 9-230709 | A | 9/1997 |
| JP | 10-78707 | A | 3/1998 |
| JP | 10-232574 | A | 9/1998 |
| JP | 2002-229346 | A | 8/2002 |
| JP | 2004-138726 | A | 5/2004 |

OTHER PUBLICATIONS

Machine translation of Takahashi et al. (JP 10-232,574), Listed in IDS.*

* cited by examiner

*Primary Examiner* — David Gray
*Assistant Examiner* — Rodney Bonnette
(74) *Attorney, Agent, or Firm* — Fitzpatrick, Cella, Harper & Scinto

(57) ABSTRACT

Deflection recessed in a bow shape at the axial central portion in the longitudinal direction of the transfer member is avoided to prevent failure in image caused by the transfer nip being improperly forming at the central portion. The pressing force of the transfer member against an image bearing member resulting in failure in transfer is made uniform in the longitudinal direction. The transfer member forming the transfer nip are pressed toward the photosensitive drum at the central portion in the longitudinal direction or in the positions which are spaced apart toward the center from the ends to avoid the deflection of the transfer member.

12 Claims, 4 Drawing Sheets

| LOAD VALUE (g) | 300 | 400 | 300 | 400 | 300 | 400 |
|---|---|---|---|---|---|---|
| DISTANCE E (mm) | 0 | 0 | (1/4×L) | (1/4×L) | (2/5×L) | (2/5×L) |
| MAXIMUM DEFLECTION AMOUNT (mm) | 0.08 | 0.11 | 0.015 | 0.02 | 0.058 | 0.077 |

IMAGE FORMING APPARATUS WITH TRANSFER MEMBER FOR TRANSFERRING TONER ON IMAGE BEARING MEMBER

BACKGROUND OF THE INVENTION

1. Field of the Invention

The present invention relates to an image forming apparatus which includes a transfer member for transferring toner on an image bearing member and presses the transfer member toward the image bearing member to form a transfer nip.

2. Description of the Related Art

Conventionally, as a color image forming apparatus such as a printer and copier, there has been disclosed a technique in which toner images formed on respective photosensitive drums are sequentially superimposed on an intermediate transfer belt and the toner images superimposed on an intermediate transfer belt are collectively transferred onto a recording material to form a color image. In addition, there has been disclosed a technique in which toner images formed on respective photosensitive drums are sequentially superimposed onto the recording material on a conveying transfer belt using the conveying transfer belt which conveys the recording material while the recording material is electro-statically adhered, to form a color image.

A transfer member transferring the toner images on the photosensitive drum is arranged at a position where the respective photosensitive drum faces toward the intermediate transfer belt or the conveying transfer belt. The transfer member is pressed against the photosensitive drum by a press member such as a spring to form a transfer nip. A transfer roller rotating to follow the intermediate transfer belt or the conveying transfer belt is generally used as the transfer member.

However, the transfer roller is pressed by the press member at both axial ends of the transfer roller to produce a deflection recessed in a bow shape at the axial central portion. This causes the nip pressure of the transfer nip to be lower at its both axial ends than that at its central portion, making the nip pressure uneven particularly in an image forming region (an image bearing region where the toner images are borne), which may cause a failure in transfer. In order to cope with the problem, there is known a technique in which the outer diameter of the roller is made larger at its central portion than that at its both axial ends to uniform the nip pressure of the transfer nip even if the axis is deflected.

However, the transfer roller is provided with an elastic member around its axis. An elastic force of the elastic member may vary the transfer nip secular change with time. The transfer roller is originally manufactured such that the outer diameter thereof is axially varied, complicating the production process.

SUMMARY OF THE INVENTION

The present invention has for its purpose to solve the above problems and to suppress a deflection recessed in a bow shape at the central portion in the longitudinal direction of the transfer member.

Another purpose of the present invention is to provide an image forming apparatus including; an image bearing member that bears toner images; a belt which moves while contacting the image bearing member; a transfer member that transfers the toner images on the image bearing member, the transfer member which faces the image bearing member and pinches the belt in cooperation with the image bearing member; and a press member that presses the transfer member toward the image bearing member; wherein the press member presses the central portion of the transfer member in the direction perpendicular to the direction in which the belt moves, wherein said transfer member does not rotate and the belt slides on the transfer member.

A further purpose of the present invention is to provide an image forming apparatus including; an image bearing member that bears toner images in a toner image bearing region; a belt that moves while contacting the image bearing member; a transfer member that transfers the toner images on the image bearing member, the transfer member which faces the image bearing member and pinches the belt in cooperation with the image bearing member; and a press member that presses the transfer member against the image bearing member in a position facing the toner image bearing region, wherein said transfer member does not rotate and the belt slides on the transfer member.

A still further purpose of the present invention will be apparent from the accompanying drawings and the following description.

DESCRIPTION OF THE EMBODIMENTS

An exemplary embodiment of the present invention is described below in detail with reference to the drawings. The dimension, materials and shape of the composing parts described in the following embodiments and a relative arrangement therebetween should be properly changed according to the configuration and/or various conditions of an apparatus to which the present invention is applied. Therefore, unless otherwise stated, it should be understood that the scope of the present invention is not limited only to the embodiments described.

The image forming apparatus of the present invention is described below in detail with reference to the drawings.

First Embodiment

An exemplary embodiment of the present invention is described below in detail with reference to the drawings. The dimension, materials and shape of the composing parts described in the following embodiments and a relative arrangement therebetween should be properly changed according to the configuration and/or various conditions of an apparatus to which the present invention is applied. Therefore, unless otherwise stated, it should be understood that the scope of the present invention is not limited only to the embodiments described.

Figure 1:
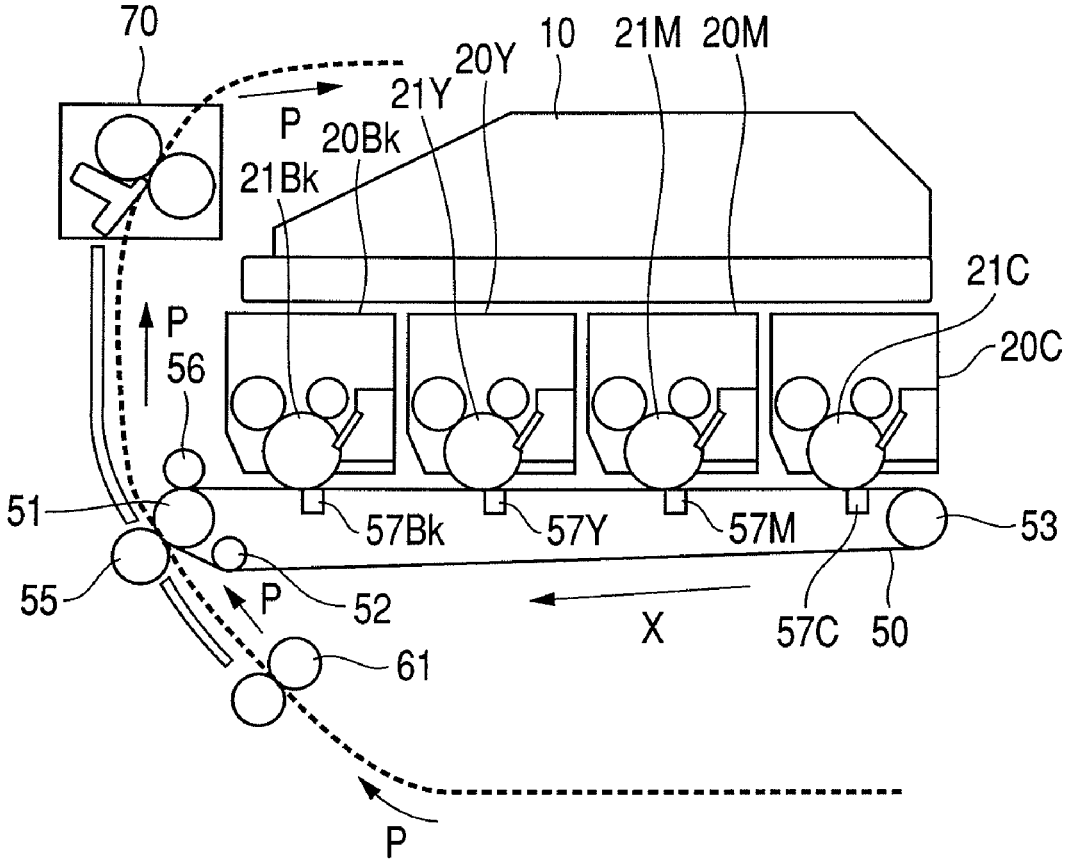
FIG. 1 is a main cross section of an image forming apparatus using an intermediate transfer belt.

The image forming apparatus according to the first embodiment is described below. The schematic configuration of the image forming apparatus is described using FIG. 1. The image forming apparatus using the intermediate transfer belt is exemplarily described herein. FIG. 1 is a main cross section of the image forming apparatus using the intermediate transfer belt.

An endless intermediate transfer belt 50 rotationally moving in an arrow direction X is arranged in the image forming apparatus illustrated in FIG. 1. The intermediate transfer belt 50 bears toner images and is formed of resin subjected to a resistance treatment. The intermediate transfer belt 50 is rotated by a driving roller 51 the surface of which is covered with a material, such as rubber, which is high in friction coefficient. The driving roller 51 is supplied with a driving force by a motor arranged in the apparatus main body. The intermediate transfer belt 50 is supported by a driven roller 52 and a tension roller 53 pressed toward the outside of the intermediate transfer belt 50 by a spring, as well as the driving roller 51.

Four image forming portions 20Bk, 20Y, 20M and 20C are arranged over the intermediate transfer belt 50 in the direction in which the belt rotationally moves. The image forming portions are a black (hereinafter referred to as "Bk"), a yellow (Y), a magenta (M) and a cyan (C) one which are different in color from each other. A process cartridge including the photosensitive drums 21Bk, 21Y, 21M and 21C as image bearing members, a charging apparatus, a developing apparatus and a cleaning apparatus which are process units acting the photosensitive drums 21 are detachably arranged in each image forming portion. The process cartridge includes a waste toner container for storing waste toner collected by the cleaning apparatus. The developing apparatus contains Bk, Y, M and C toners.

The rotatable photosensitive drum 21 is irradiated with laser beams of image signals from an optical unit 10 through a polygon mirror (not shown) to form an electrostatic image on the photosensitive drum 21. By supplying toner to the electrostatic image from the developing apparatus, the electrostatic image is developed and visualized as a toner image. The toner image reaching a primary transfer portion where the photosensitive drum 21 abuts on the intermediate transfer belt 50 as the photosensitive drum 21 rotates transfers the toner images on the photosensitive drum 21 onto the intermediate transfer belt 50 by a primary transfer bias applied to a transfer member 57 (primary transfer).

Similarly, as the intermediate transfer belt 50 moves, the toner images are sequentially and transferred onto the intermediate transfer belt 50 and superimposed with each other at the primary transfer portion of the second, the third and the fourth image forming portion. A recording material P conveyed from a feeding cassette reaches a secondary transfer portion through a resistive roller 61 and four-color toner images on the intermediate transfer belt 50 are collectively transferred onto the recording material P by a secondary transfer bias applied to a secondary transfer member 55 (secondary transfer).

The toner remaining on the belt 50 which has passed the secondary transfer portion is cleaned by a cleaning unit 56. The recording member P onto which the toner images are transferred is detached from the intermediate transfer belt 50 and sent to a fixing device 70. The fixing device 70 applies heat and pressure to the recording material P to fix the toner images onto the recording member P.

Figure 2:
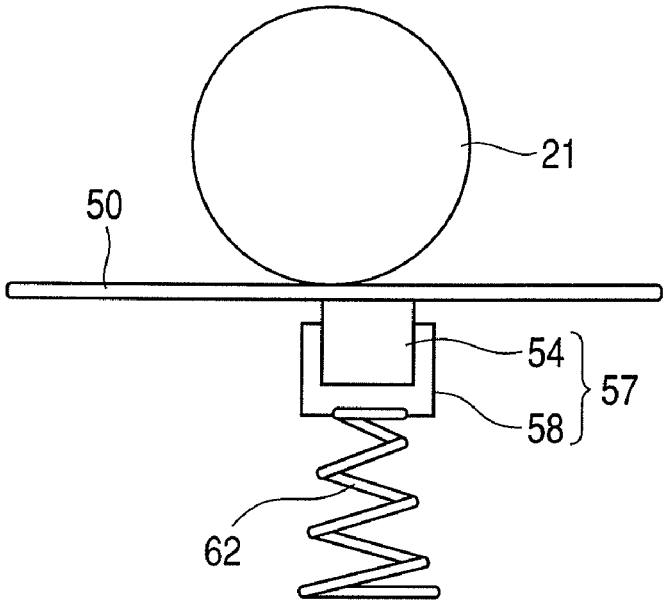
FIG. 2 is a cross section of a transfer portion.

The configuration of the primary transfer portion is described herein. FIG. 2 is an enlarged cross section of the essential part around the primary transfer portion illustrated in FIG. 1. Each primary transfer portion has the same configuration. As illustrated in FIG. 2, the transfer member 57 includes an elastic member 54 being a rectangular-parallelepiped-shaped sponge which does not rotate and a support member 58 for supporting the elastic member 54. The transfer member 57 is pressed toward the photosensitive drum 21 by a press member 62 such as a spring. The transfer member 57 is brought into contact with the other surface of the intermediate transfer belt 50. The rotation (movement) of the intermediate transfer belt 50 rubs the intermediate transfer belt 50 against the transfer member 57.

The elastic member 54 is made of a sponge subjected to a resistance treatment and is elastic. It is desirable to use, for example, urethane foam whose Young's modulus is 0.8 Mpa or less. The elastic member 54 is supported by the support member 58 made from resin and pressed toward the photosensitive drum 21 by a press member 62. The elastic member 54 is glued onto the support member 58. The transfer member 57 is brought into contact with the press member 62 in one central position in the longitudinal direction of the transfer member 57 (or, in the direction perpendicular to the direction in which the intermediate transfer belt 50 moves). The term "central position" herein refers to the vicinity of the central position of an actual apparatus, and does not refer to an exact central position. A primary transfer voltage is supplied to the transfer member 57 through the press member 62. The press member 62 is the one which presses the transfer member 57 against the photosensitive drum 21.

Figure 3:
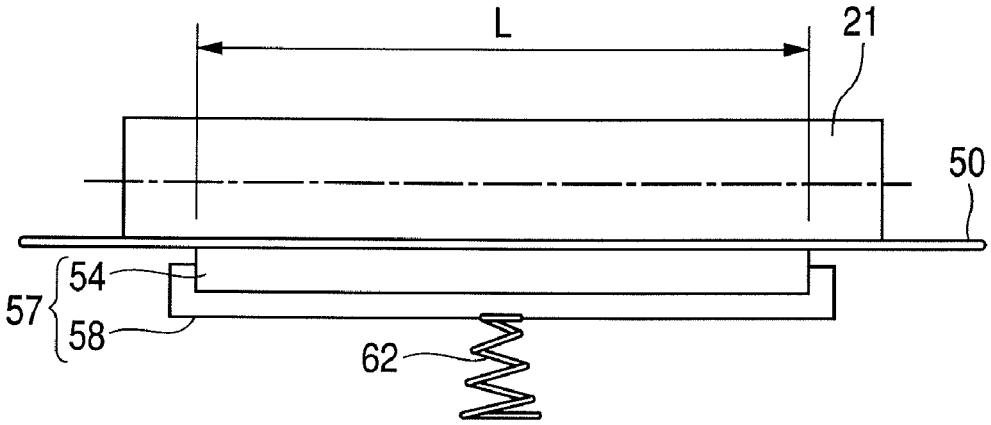
FIG. 3 is a cross section in the longitudinal direction of a transfer portion according to a first embodiment.

FIG. 3 is a schematic diagram illustrating a configuration in the longitudinal direction of the primary transfer portion in FIG. 2. The press member 62 presses the transfer member 57 within a toner image bearing region L (a region where the toner images on the image bearing member are borne) in the longitudinal direction of the photosensitive drum 21.

Figure 4:
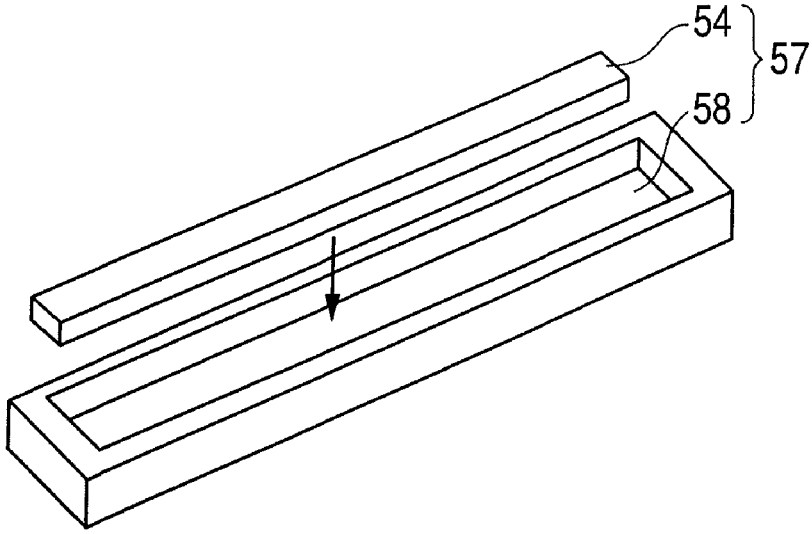
FIG. 4 is a perspective view of the transfer member and the support member.

The elastic member 54 is supported by the support member 58. The support member 58 is of a box shape adapted to receive the elastic member 54 as illustrated in FIG. 4. The support member 58 is made from a resin mold member and has a Young's modulus of 22 Mpa to 25 Mpa.

Although the transfer member 57 has the support member 58, the support member 58 is not a complete rigid body, so that the transfer member 57 is deflected. Since a pressing mechanism faces a position facing the toner image bearing region L in the present embodiment, a transfer nip is more stably formed in the toner image bearing region L as compared with the case where the transfer member 57 is pressed outside the toner image bearing member. Furthermore, in the present embodiment, the central portion in the longitudinal direction of the transfer member 57 is pressed, so that image quality at the central region, of which users apt to be aware, among toner images formed by the image forming apparatus is most preferentially secured. Pressing the position facing the toner image bearing region L by the press member enables shortening the configuration in the longitudinal direction of the transfer portion. This is because a configuration of pressing the outside of the position facing the toner image bearing region L by the press member needs to arrange the press member outside the toner image bearing region L in its longitudinal direction.

The present embodiment uses a transfer member which does not rotate. If a rotary transfer member such as a transfer roller is used, many restrictions are imposed on the pressure of the central portion of the transfer member. The transfer roller generally has an elastic member around its shaft and uses a sponge as its elastic member. The sponge is formed over the shaft of the transfer roller, so that the sponge portion being the surface of the rotating transfer roller is pressed in the range of the toner image bearing region L where transfer is performed. This requires stably pressing of the sponge portion of the transfer roller without losing the rotation of the transfer roller. This requires a high sliding characteristic between the transfer roller and the press member and a high restoring force of the elastic member of the transfer roller. This is because the surface of the transfer roller (elastic member) is pressed by the press member to temporarily recess the pressed portion and then the recessed portion faces the transfer nip without restoring the recess caused by the press member to degrade the transfer performance.

According to the above-described configuration, a non-rotating body is used as the transfer member 57. The central portion of the transfer member 57 is pressed by the press member 62 toward the photosensitive body to form the transfer nip.

The rectangular-parallelepiped-shaped transfer member 57 is used to bring its one face in contact with the other face of the intermediate transfer belt 50, thereby enabling setting the width of the transfer nip at discretion and forming the transfer portion with a good performance.

In addition, the primary transfer member 57 is formed of the elastic member and supported by the support member capable of holding the shape of the primary transfer member 57 to allow forming the substantially uniform width of the transfer nip along the longitudinal direction of the transfer nip portion even if the pressing force of the press member 62 is set low. Since the transfer member 57 rubs the intermediate transfer belt 50, a small pressing force of the press member permits reducing the rubbing force applied to the transfer member 57 and the intermediate transfer belt 50, contributing the formation of a more stable transfer nip.

Second Embodiment

Figure 5:
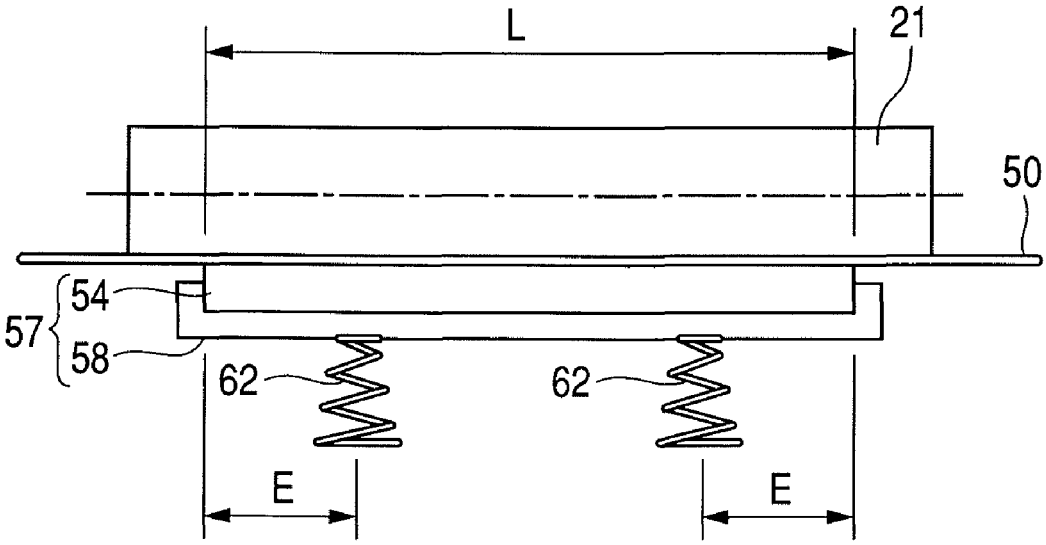
FIG. 5 is a cross section in the longitudinal direction of a transfer portion according to a second embodiment.

The image forming apparatus according to the second embodiment is described below. The schematic configuration of the entire image forming apparatus is the same as that of the afore-mentioned embodiment, so that the description thereof is cited. Only the primary transfer portion different in configuration from that in the above embodiment is described herein. FIG. 5 is a schematic view illustrating a configuration in the longitudinal direction of the primary transfer portion in FIGS. 1 and 2. Although the configuration in which the press member presses the transfer member in its one central position in the longitudinal direction of the transfer member and in the image bearing region of the image bearing member is exemplified, the present invention is not limited to the configuration.

In the present embodiment, as illustrated in FIG. 5, a plurality of positions of the transfer member 57 are pressed by the press member 62 to press the transfer member 57 more uniformly toward the photosensitive drum. The press positions are spaced a distance E apart from both ends of the transfer member 57 and are on the central side in the longitudinal direction of the transfer member 57.

In the present embodiment, as illustrated in FIG. 5, the press members 62 press two positions which are spaced an equal distance E apart inward from the ends of the transfer member 57, the ends in the direction perpendicular to the direction in which the belt 50 moves, and are in the toner image bearing region L of the photosensitive drums 21. This permits the transfer member 57 to be more uniformly pressed toward the photosensitive drum than the transfer member 57 in the foregoing embodiment.

Figures 6, 7:
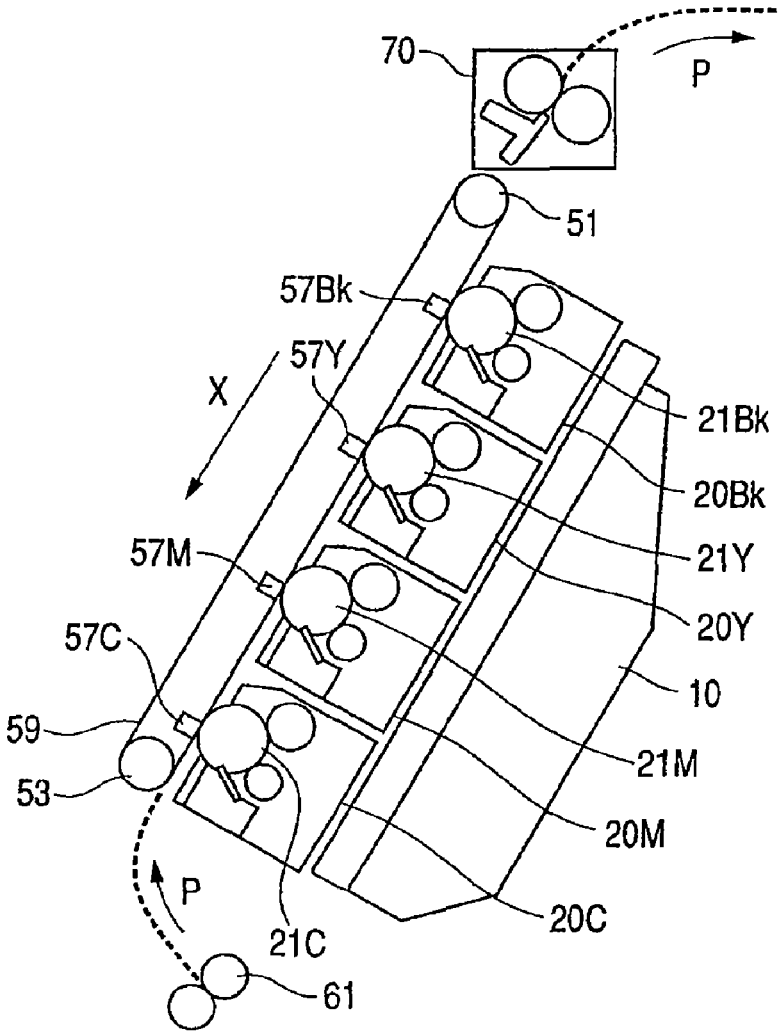
FIG. 6 is a table expressing a relationship between a position where the press member presses and deflection of the support member caused by a pressing force.
FIG. 7 is a main cross section of an image forming apparatus using a transfer member conveying belt.

FIG. 6 shows the toner image bearing region L, the distance E by which the press members 62 are spaced from the ends, the maximum displacement (deflection) of the support member 58 caused by a pressing force (load value) of the press member 62. The maximum displacement of the support member 58 at the position where the press members 62 are spaced by a distance E=L/4 is reduced to about one-sixth (⅙) of that by a distance E=0.

On the other hand, disposing the press member 62 outside the toner image bearing region L using the transfer member 57 which does not rotate and is supported causes the support member 58 to generate a bow-shaped deflection at the central portion of the transfer nip, adversely influencing the transfer at the central portion of an image. In order to avoid the above drawback without using a stiffened support member (reinforcing member), as described above, the press members 62 are arranged at two positions which are in the toner image bearing region L and spaced a distance E=about L/4 apart inward from the ends. This arrangement allows securing more uniform nip pressure as well as the effects of the above embodiment without using a stiffened support member, providing satisfactory transfer. Incidentally, although the press members 62 are arranged at positions which are spaced the equal distance apart from both ends of the transfer member 57, the distance does not need to be completely equal to each other. The press position of the press member 62 can be adjusted unless the transfer member 57 loses balance of pressure against the transfer nip.

Other Embodiments

In the above embodiments, although the image forming apparatus using the intermediate transfer belt 50 for bearing toner images is exemplified and applications of the present invention to the primary transfer portion of the image forming apparatus are exemplarily described, the present invention is not limited to those embodiments. The present invention can be applied to an image forming apparatus using a recording material bearing belt 59 for bearing a recording material, for example, as illustrated in FIG. 7.

FIG. 7 is a main cross section of an image forming apparatus using a recording material bearing belt.

The recording material bearing belt 59 which is endless and rotationally moves in an arrow direction X is arranged in the image forming apparatus illustrated in FIG. 7. The recording material bearing belt 59 is the one which bears the recording material and is formed from resin subjected to a resistance treatment. The recording material bearing belt 59 is driven by a driving roller 51. The driving roller 51 is supplied with a driving force by a motor arranged in the apparatus main body. The recording material bearing belt 59 is supported by a tension roller 53 stretched by a tension applying unit such as a spring in addition to the driving roller 51.

Four image forming portions 20Bk, 20Y, 20M and 20C are arranged at the positions contacting the recording material bearing belt 59 and along the direction in which the belt rotationally moves. The image forming portions are a black (hereinafter referred to as "Bk"), a yellow (Y), a magenta (M) and a cyan (C) one which are different in color from each other. A process cartridge including a photosensitive drum 21 as an image bearing member, a charging apparatus, a developing apparatus and a cleaning apparatus as process units acting the photosensitive drums 21 is detachably arranged in each image forming portion. The process cartridge includes a waste toner container for storing waste toner collected by the cleaning apparatus. The developing apparatus contains Bk, Y, M and C toners.

The rotatable photosensitive drum 21 is irradiated with laser beams of image signals from an optical unit 10 through a polygon mirror (not shown) to form an electrostatic image on the photosensitive drum 21. By supplying toner to the electrostatic image from the developing apparatus, the electrostatic image is developed and visualized as a toner image. The toner image reaching a transfer portion where the photosensitive drum 21 abuts on the recording material bearing belt 59 as the photosensitive drum 21 rotates transfers the toner image on the photosensitive drum 21 onto the recording material P borne on the recording material bearing belt 59 by the transfer bias applied to a transfer member 57.

Similarly, as the recording material bearing belt 59 moves, the toner images are sequentially and superimposedly transferred onto the recording material P borne on the recording material bearing belt 59 at the transfer portions of the second, the third and the fourth image forming portions. The recording material P on which all toner images are transferred is detached from the recording material bearing belt 59 and sent to a fixing device 70. A pair of rollers in the fixing device 70 applies heat and pressure to the recording material P to fix the toner images onto the recording material P.

The application of the same configuration as in the transfer portions of the foregoing embodiments (refer to FIGS. 2, 3 and 5) to the transfer potions of the image forming apparatus using the recording material bearing belt 59 also brings about the same effect.

The foregoing embodiments exemplify two configurations in which the transfer member is pressed by the press member: the one in which the press member presses one central position in the longitudinal direction of the transfer member and in the image bearing region of the image bearing member; and the other in which the press members press two positions which are spaced an equal distance apart inward from the ends in the longitudinal direction of the transfer member and are in the image bearing region of the image bearing member. However, as long as the transfer member is uniformly pressed along its longitudinal direction against the image bearing member, the arrangement and the number of the press members in the image bearing region of the image bearing member are not limited to those embodiments.

Although the above embodiment uses four image forming portions, the number of the image forming portions to be used is not limited to four, but may be properly selected as required.

The above embodiment exemplifies the process cartridge integrally including the photosensitive drums, the charging unit, the developing unit and the cleaning unit as process units acting the photosensitive drums, as the process cartridge detachable from the image forming apparatus main body. However, a process cartridge is not limited to the above one, but may integrally include any one of the charging unit, the developing unit and the cleaning unit in addition to the photosensitive drums.

Although the above embodiment exemplifies a configuration in which the process cartridge including the photosensitive drums can be detached from the image forming apparatus main body, the present invention is not limited to the configuration. For example, each composing member may be independently assembled into the image forming apparatus, alternatively, each composing member may be independently detached from the image forming apparatus. The application of the present invention to the transfer portion of the above image forming apparatus brings about the same effect.

Although the above embodiment exemplifies a printer as an image forming apparatus, the present invention is not limited to the printer, but may be applied to, for example, other image forming apparatus such as a copier and a facsimile apparatus, or to other image forming apparatus such as a compound apparatus combining these functions. The application of the present invention to the transfer portion of the above image forming apparatus brings about the same effect.

The present invention is described above with reference to specific embodiments. It is to be understood that the present invention is not limited to the above embodiments.

For example, the transfer member may be of a rectangular parallelepiped shape whose end is rectangular, as well as of a rectangular parallelepiped shape whose cross section is substantially square.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-102519, filed Apr. 10, 2007, which is hereby incorporated by reference herein in its entirety.

What is claimed is:

1. An image forming apparatus comprising:

an image bearing member that is rotatable about a rotation axis;

an endless belt that is movable in a moving direction;

a transfer member that transfers a toner image on said image bearing member, wherein said transfer member contacts an inside surface of said endless belt and pinches said endless belt in cooperation with said image bearing member, wherein said transfer member includes a contact portion having a contact surface that contacts the inside surface of said endless belt, and a support member that supports the contact portion, wherein the contact portion contacts the inside surface of said endless belt without rotating with respect to said support member while said endless belt moves; and a press member that presses said support member towards said image bearing member, wherein in a longitudinal direction of said support member whose direction is the same as an axial direction of the rotation axis of said image bearing member, a first position at which said press member presses said support member and a second position at which said support member contacts the contact portion to support the contact portion are provided at least inside an area in which said image bearing member bears a toner image in the axial direction of the rotation axis of said image bearing member.

2. An image forming apparatus according to claim 1, wherein in the longitudinal direction of said support member, the portion at which said press member presses said support member is between both ends of the contact portion in a longitudinal direction of the contact portion whose direction is the same as the axial direction of the rotation axis of said image bearing member.

3. An image forming apparatus according to claim 1, wherein a transfer bias voltage to transfer a toner image is applied to the transfer member.

4. An image forming apparatus according to claim 1, wherein the contact portion includes an elastic member, wherein said elastic member has a rectangular-parallelepiped-shape.

5. An image forming apparatus according to claim 1, wherein in the longitudinal direction of said support member, the area in which a toner image on said image bearing member in a rotation axis of said image bearing member is borne further includes one or more first positions at which said press member press said support member.

6. An image forming apparatus according to claim 5, wherein said press member presses said support member at two first positions, each of the two first positions are distantly positioned with a common distance from each of the ends in the longitudinal direction of said support member.

7. An image forming apparatus according to claim 1, wherein said transfer member transfers the toner image on said image bearing member onto said endless belt and the toner image transferred onto said endless belt is transferred onto a recording material.

8. An image forming apparatus according to claim 1, wherein said endless belt bears a recording material and said transfer member transfers the toner image on said image bearing member onto the recording material borne by said endless belt.

9. An image forming apparatus according to claim 1, wherein said support member includes a resin-formed member.

10. An image forming apparatus according to claim 1, wherein in the longitudinal direction of said support member, the first position is a center of the area.

11. An image forming apparatus according to claim 1, wherein a length of said transfer member in the longitudinal direction of said transfer member that is the same as the axial direction of the rotation axis of said image bearing member is shorter than a length of said image bearing member in the direction of the rotation axis of said image bearing member.

12. An image forming apparatus according to claim 1, wherein the contact portion is supported by said support member that contacts the contact portion in the entirety of the area in the longitudinal direction of the support member.

* * * * *